US006571880B1

(12) United States Patent
Butterfield, Jr. et al.

(10) Patent No.: US 6,571,880 B1
(45) Date of Patent: Jun. 3, 2003

(54) METHOD AND MULTI-PURPOSE APPARATUS FOR CONTROL OF FLUID IN WELLBORE CASING

(75) Inventors: Charles A. Butterfield, Jr., Cypress, TX (US); Robert A. Bates, Houma, LA (US); David F. Laurel, Cypress, TX (US); Samuel P. Hawkins, Mineral Wells, TX (US); Burney J. Latiolais, Jr., Lafayette, LA (US); Keith T. Lutgring, Lafayette, LA (US)

(73) Assignee: Frank's International, Inc., Houston, TX (US)

( * ) Notice: Subject to any disclaimer, the term of this patent is extended or adjusted under 35 U.S.C. 154(b) by 0 days.

(21) Appl. No.: 09/559,243

(22) Filed: Apr. 26, 2000

Related U.S. Application Data

(60) Provisional application No. 60/132,044, filed on Apr. 30, 1999.

(51) Int. Cl.[7] ..... E21B 33/12; E21B 34/68

(52) U.S. Cl. ..... 166/386; 166/193; 166/318; 166/332.4; 166/374

(58) Field of Search ..... 166/193, 318, 166/321, 323, 332.4, 373, 374, 386

(56) References Cited

U.S. PATENT DOCUMENTS 3,768,556 A * 10/1973 Baker ..... 166/154
4,042,014 A * 8/1977 Scott ..... 166/367
4,246,968 A * 1/1981 Jessup et al. ..... 166/317
4,934,460 A * 6/1990 Coronado ..... 166/386
5,048,611 A * 9/1991 Cochran ..... 166/374
5,443,122 A * 8/1995 Brisco ..... 166/285
5,960,884 A * 10/1999 Echols ..... 166/317
6,003,607 A * 12/1999 Hagen et al. ..... 166/381
6,053,250 A * 4/2000 Echols ..... 166/317

* cited by examiner

*Primary Examiner*—David Bagnell
*Assistant Examiner*—Jennifer H Gay
(74) *Attorney, Agent, or Firm*—The Matthews Firm

(57) ABSTRACT

A downhole apparatus is described as having an upper mandrel shearably connected to a lower mandrel by a first set of shear pins. Each of the mandrels has an elastomeric cement plug formed around the mandrels. A sleeve is shearably connected within the lower mandrel. The operation of the apparatus, which includes a method for controlling the flow of fluid out of the end of a tubular string, involves dropping a first small diameter ball from the earth3 s surface. The ball is sized such that it travels through the upper mandrel and settles into the sleeve which is connected within the lower mandrel. By increasing pump pressure at the earth's surface, the lower mandrel is separated from the upper mandrel by shearing the first set of shear pins. After the separation of the lower mandrel from the upper mandrel, by further increasing the pump pressure at the earth's surface, a second set of shear pins are sheared and the lower mandrel can be pumped down to the bottom of the tubular string against a float collar or other plug landing surface. This enables the fluid within the tubular string to be pumped out of the lower mandrel into the earth borehole. When it is desired to separate the upper mandrel from the tubular string, the second, larger ball is dropped from the earth's surface and is seated within the upper mandrel. By further increasing the pump pressure, the upper mandrel is separated from the tubular string and can be pumped down against the lower mandrel.

22 Claims, 3 Drawing Sheets

METHOD AND MULTI-PURPOSE APPARATUS FOR CONTROL OF FLUID IN WELLBORE CASING

RELATED APPLICATION

This application claims priority from U.S. Provisional Patent Application, Ser. No. 60/132,044, filed Apr. 30, 1999.

FIELD OF INVENTION

This invention relates generally to equipment used in the drilling, completion and workover of subterranean wells and more specifically, to the control of drilling fluids, completion fluids, workover fluids, cement, and other fluids in a casing or other tubular string within a wellbore.

BACKGROUND

The process of drilling subterranean wells to recover oil and gas from reservoirs consists of boring a hole in the earth down to the petroleum accumulation and installing pipe from the reservoir to the surface. Casing is a protective pipe liner within the wellbore that is cemented into place to ensure a pressure-tight connection of the casing to the earth formation containing the oil and gas reservoir. The casing is run a single joint at a time as it is lowered into the wellbore. On occasion, the casing becomes stuck and is unable to be lowered into the wellbore. When this occurs, load must be added to the casing string to force the casing into the wellbore, or drilling fluid must be circulated down the inside diameter of the casing and out of the casing into the annulus in order to free the casing from the wellbore. To accomplish this, it has traditionally been the case that special rigging be installed to add axial load to the casing string or to facilitate circulating the drilling fluid.

When running casing, drilling fluid is added to each joint as it is run into the well. This procedure is necessary to prevent the casing from collapsing due to high pressures within the annulus inside the wellbore exterior to the casing. The drilling fluid acts as a lubricant which facilitates lowering the casing within the wellbore. As each joint of casing is added to the string, drilling fluid is displaced from the wellbore. The prior art discloses hose assemblies, housings coupled to the uppermost portion of the casing, and tools suspended from the drill hook for filing the casing. These prior art devices and assemblies have been labor intensive to install, required multiple such devices for multiple casing string sizes, have not adequately minimized loss of drilling fluid, and have not been multi-purpose. Further, disengagement of the prior art devices from the inside of the casing has been problematic, resulting in damage to equipment, increased downtime, loss of drilling fluid, and injury to personnel.

Circulating of the drilling fluid is sometimes necessary if resistance is experienced as the casing is lowered into the wellbore. In order to circulate the drilling fluid, the top of the casing must be sealed so that the casing may be pressurized with drilling fluid. Since the casing is under pressure, the integrity of the seal is critical to safe operation and to minimize the loss of the expensive drilling fluid. Once the casing reaches the bottom, circulating of the drilling fluid is again necessary to test the surface piping system, to condition the drilling fluid in the hole and to flush out wall cake and cuttings from the hole. Circulating is continued until at least an amount of drilling fluid equal to the volume of the inside diameter of the casing has been displaced from the casing and the wellbore. After the drilling fluid has been adequately circulated, the casing may be cemented into place.

The purpose of cementing the casing 500 (See FIG. 3A through FIG. 3C) is to seal the casing to the wellbore formation. In order to cement the casing within the wellbore 502, hereinafter the assembly to fill and circulate drilling fluid is generally removed from the drilling rig and a cementing head apparatus installed. This process is time consuming, requires significant manpower, and subjects the rig crew to potential injury when handling and installing the additional equipment to flush the mud out with water or other chemical hereinafter prior to the cementing step. A special cementing head or plug container is installed on the top portion of the casing being held in place by the elevator. The cementing head includes connections for the discharge line of the cement pumps, and typically includes a bottom hereinafter506 and top wiper plug hereinafter 508. Since the casing and wellbore are full of drilling fluid, it is necessary to inject a spacer fluid to segregate the drilling fluid from the cement to follow. The hereinafter bottom cementing plug hereinafter 506 is used to wiped the inside diameter of the casing and serve, in conjunction with the spacer fluid, to separate the drilling fluid from the cement as the cement is pumped down the casing string hereinafter 500. Once the calculated volume of cement required to fill the annulus has been pumped, the top plug hereinafter 508 is released from the cementing head. Drilling fluid or some other suitable fluid is then pumped in behind the top plug, thus transporting both plugs and the cement contained between the plugs to an apparatus at the bottom of the casing known as a float collar hereinafter 510. Once the bottom plug hereinafter506 seals the bottom of the casing, the pump pressure increases, rupturing, for example, a diaphragm in the bottom of the plug hereinafter 506 and allowing the calculated amount of cement to flow hereinafter as indicated by flow lines 512 from the inside diameter of the casing to a certain level with the annulus hereinafter 504 being cemented. The annulus hereinafter 504 is the space within the wellbore between the inside diameter ("ID") of the wellbore and the outside diameter ("OD") of the casing string. When the top check valve closes, keeping the cement from flowing from the OD of the casing back into the ID of the casing.

The prior art typically discloses separate devices and assemblies for (i) filling and circulating drilling fluid; and (ii) cementing operations. The prior art devices for filling and circulating drilling fluid disclose a packer tube, which requires a separate activation step once the tool is positioned within the casing. The packer tubes are known in the art to be subject to malfunction due to plugging, leaks, and the like, leading to downtime. Since each step in the well drilling process is potentially dangerous, time consuming, labor intensive and therefore expensive, there remains a need in the art to minimize any downtime. One advantage in this art is described in U.S. Pat. No. 5,735,348, issued on Apr. 7, 1998 to Samuel P. Hawkins for "Method and Multi-Purpose Apparatus for Dispensing and Circulating Fluid in Wellbore Casing," some of the components of which can be used, as but one example, in using the present invention.

DETAILED DESCRIPTION OF THE PREFERRED EMBODIMENT

Figure 1A:
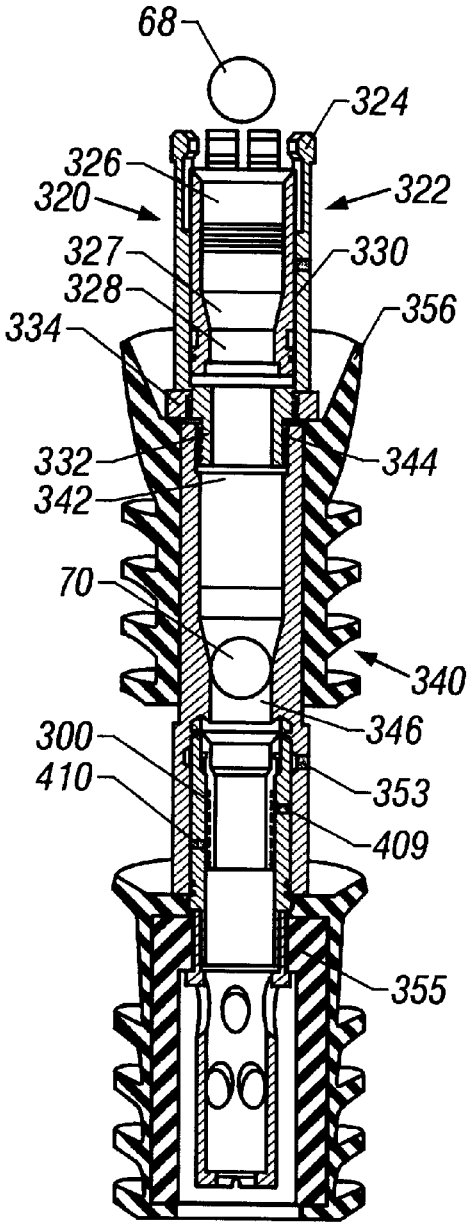
FIG. 1A: Illustrates hereinafter the initial effects of a sequence hereinafter of dropping a pair of balls from the earth's surface into the downhole apparatus according to the present invention.
Figure 1B:
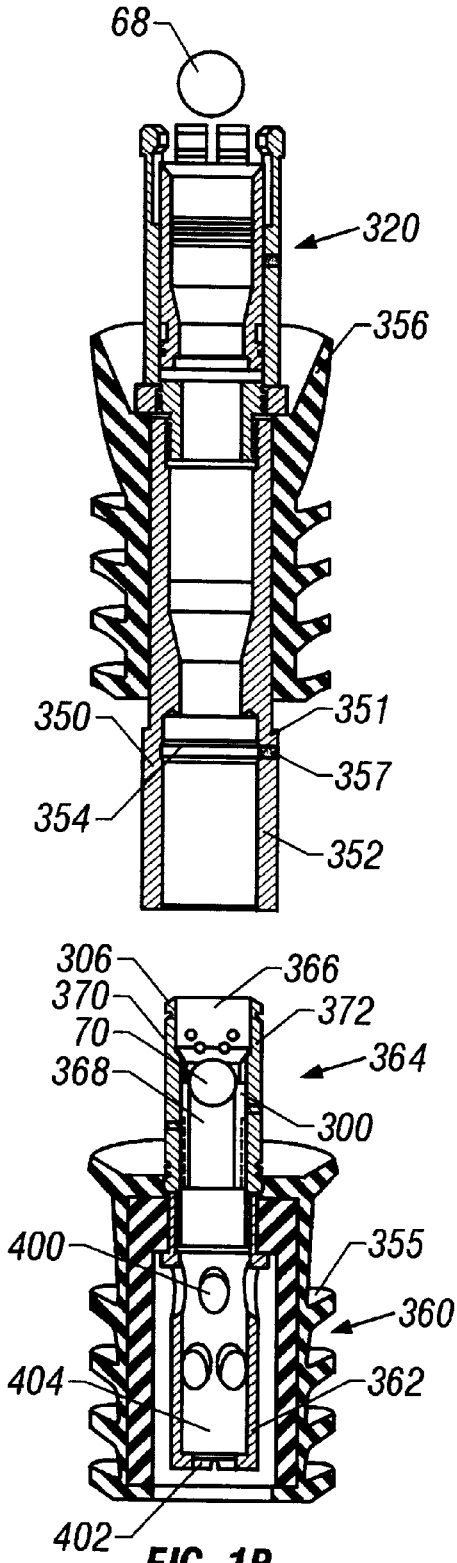
FIG. 1B Illustrates separation of an upper mandrel and lower mandrel such that lower mandrel drops into the wellbore.
Figure 1C:
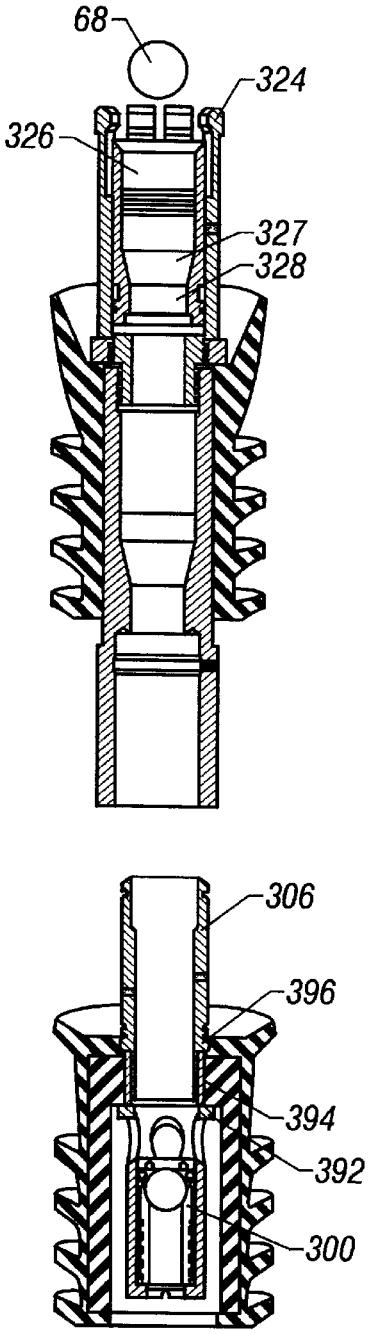
FIG. 1C Illustrates opening passageway in lower mandrel and initial steps of launching upper mandrel to drop into the wellbore

Referring now to FIG. 1(*a*), there is illustrated an upper cylindrical mandrel 320, having an upper sub-mandrel 322, the upper end 324 of the sub-mandrel 322 comprising an externally flared, contractible collet. The invention contemplates the use of two balls, one being referred to as a small ball, and one as a larger ball. The upper sub-mandrel 322 has three progressively smaller axial bores, commencing at the collet end 324 with axial bore 326 followed by axial bores 327 and 328, axial bore 328 being sized to allow passage of a smaller ball, but not a larger ball. A first section 330 of the external side wall of the sub-mandrel 322 is threaded and of reduced diameter of the remainder of the sub-mandrel 322. A second section 332 of the external side wall is threaded and of an even smaller diameter than that of section 330. The section 330 has a male thread, around which a shoulder ring 334 is threadedly connected.

Referring further to FIG. 1(*a*), a lower sub-mandrel 340, being part of the upper mandrel 320, has a first axial bore 342, the upper end of which has a female thread 344 to accept the male thread of section 332. The axial bore 342 tapers inwardly to a reduced diameter axial bore 346, through which a smaller ball can pass.

The external wall of the sub-mandrel 340 has a reduced diameter section 350 and a larger diameter section 352 on its end. The transition between the sections 350 and 352 forms a shoulder 351. A conventional elastomeric cement plug 356 is sized to fit over the section 350 and is locked into place between the shoulder 351 and the shoulder ring 334.

The section 352 has a larger diameter axial bore, approximately the same diameter as axial bore 327. The interior side wall of the axial bore 352 has a circular groove 354 for accepting a plurality of round balls, preferably of glass, ceramic or other drillable materials. In the preferred embodiment, four such balls (not illustrated) are used in the groove 354. One or more threaded holes hereinafter 353 are in the side wall of section 352 and which feed into the groove 354. After the four balls are fed into the groove 354, a plug (not illustrated) is threadably connected into each of the holes hereinafter 353 to block them off and keep the balls captured in the groove 354.

Referring further to FIG. 1(*a*), a lower mandrel 360 comprises a cylindrical lower-sub-mandrel 362 and a cylindrical upper sub-mandrel 364. The sub-mandrel 362 has a first axial bore 366 size to accept the sleeve 300 of FIG. 2, but has a reduced diameter axial bore 368 which will initially block the flared, contractible collet end 306 of sleeve 300. The side wall 370 around the axial bore 377 has a plurality of holes 372 therethrough, preferably four holes in which the glass or plastic balls can reside while also in the groove 354. A plurality of shear pins, preferably four, are threaded through the sidewall 370 of the axial bore 368 to ride in the longitudinal slots in sleeve 300, illustrated in FIG. 2. A pair of grooves 308 and 310 are formed in the exterior side walls and around axial bores 366 and 368, respectively, and are used to house o-rings (not illustrated) for preventing fluid loss between the sub-mandrel 364 and the sub-mandrel 340.

The sub-mandrel 362 has a raised shoulder 392 and a threaded (female) portion to threadedly engage a threaded (male) lower end 394 of the upper sub-mandrel 364. The lower sub-mandrel 364 has a raised shoulder 396. A conventional, elastomeric cement plug 355 is sized to fit over the threaded connection between the shoulders 392 and 396 and is secured to the lower mandrel 360 by such shoulders.

The lower sub-mandrel 362 has a plurality of holes hereinafter 400 through its sidewall below the shoulder 396, and also has an end cap hereinafter 402 at its lowermost end with an opening through the cap hereinafter 402 of a diameter less than the axial bore hereinafter 404 to which the holes hereinafter 400 are connected. The cap hereinafter 402 has a slot in its lower side to assist in making up the various threaded connections. The bore hereinafter 404 is sized to accept the sleeve 300 all the way down to the cap hereinafter 402, against which the sleeve 300 comes to rest.

Figure 2:
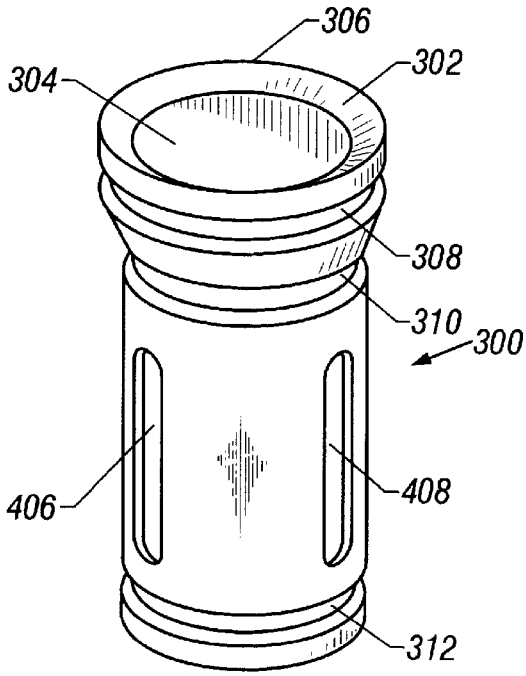
FIG. 2: Illustrates the sleeve which is moved down by dropping the first of two balls from the earth's surface and increasing the pump pressure.
Figure 3C:
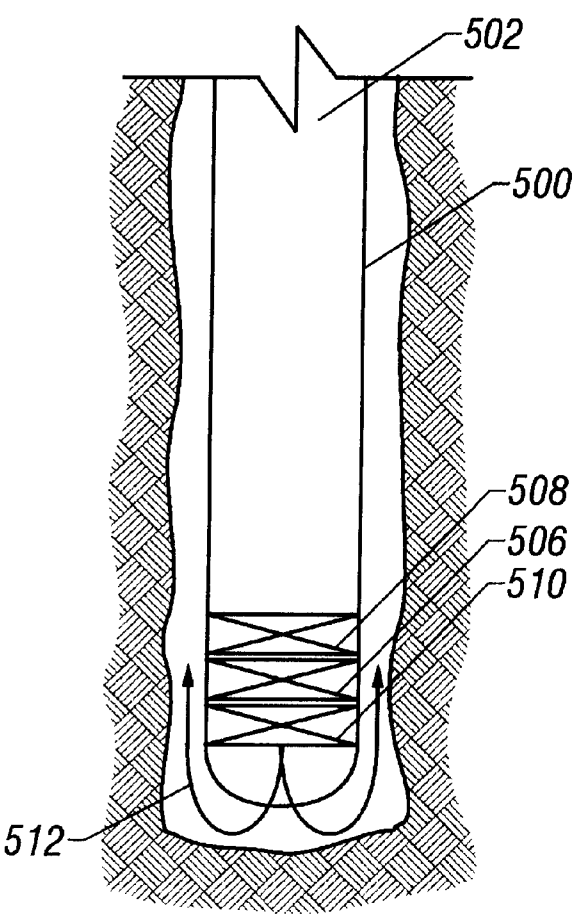
FIG. 3C Illustrates upper cement wiper plug pumped to top of lower cement wiper plug.
Figure 3B:
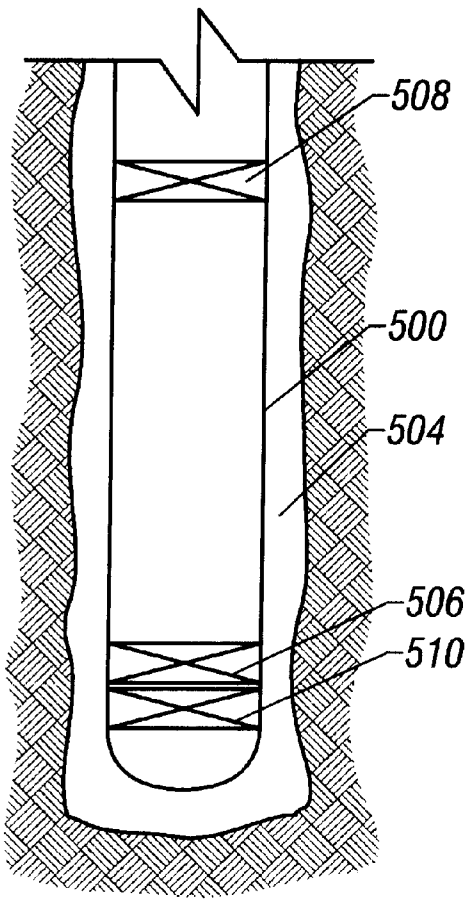
FIG. 3A Illustrates initial configuration of typical cementing operation. hereinafter FIG. 3B Illustrates lower cement wiper plug pumped to top of float shoe or collar.
Figure 3A:
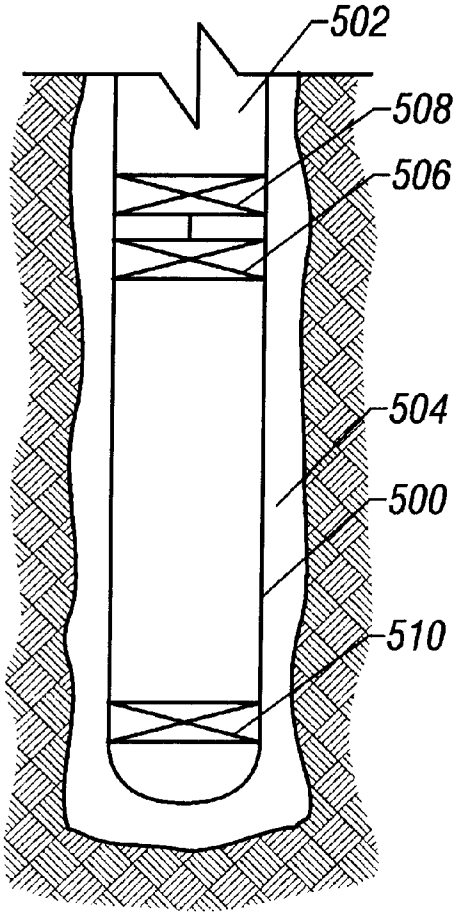

Referring now to FIG. 2, there is illustrated a cylindrical sleeve 300 having a first axial bore 302 of a diameter sized to accept a first dropped ball, i.e., 1⅝," and a second axial bore 304 sized to stop the first dropped ball. The upper end 306 comprises an externally flared, contractible collet.

External grooves 308, 310 and 312, perpendicular to the longitudinal axis of the sleeve 300, with grooves 308 and 310 at collet end 306, and groove 312 at the opposite end of the sleeve 300, use o-rings (not illustrated) to provide a fluid seal in the operation of the sleeve 300, described hereinbelow.

Four equally spaced longitudinal slots, of which only slots 406 and 408 are illustrated, are spaced about the periphery of the sleeve 300, parallel to the longitudinal axis of the sleeve 300, within which a pair of shear pins hereinafter 409 and a pair of shear pins 410, respectively, can ride and are protected until the sleeve has moved sufficiently to shear the shear pin pairs hereinafter 409 and 410.

In making up the tools illustrated in FIGS. 1 and 2, the lower mandrel 360 can be rotated with respect to the upper mandrel 320 to align the holes 372 and hereinafter 353 to feed the small "marble sized" balls into the groove 354. The holes hereinafter 353 are then plugged up. The sleeve 300 keeps the small balls in place within the groove 354 and holes 372, thus locking the upper mandrel 320 to the lower mandrel 360, while allowing rotation between the two mandrels.

In the operation of the system described herein, with the equipment ready to be run into the interior of the casing string, whether to circulate fluid, fill-up the casing, to cement the casing to the earth formation walls, or otherwise control fluid according to the preferred embodiment of the invention, the system requires that a pair of balls be dropped, a first smaller ball, i.e., having a 1⅝" diameter, and then a larger ball, i.e., having a 1⅞" diameter. The balls should be a drillable material in the event of malfunction requiring the entire apparatus to be drilled out. The balls can be dropped manually, or can be dropped sequentially through the use of various ball-drop mechanisms known in the art.

As soon as the smaller ball enters the top end of the upper mandrel 320 of FIG. 1(*a*), it passes all the way down to the sleeve 300 residing in the upper end of lower mandrel 360. By increasing pump pressure at the earth's surface and hence, by increasing differential fluid pressure across the first dropped ball 70, the sleeve 300 shears the first set of shear pins hereinafter 409, at a predetermined pressure, i.e., 1,000 psi. This causes the sleeve 300 to move down and uncover the small balls in the groove 354 and holes hereinafter 357, allowing the small balls to drop out and the lower mandrel to separate from the upper mandrel, as illustrated in FIG. 1(*b*). As the now separated lower mandrel 360 is pumped down after being separated from the upper mandrel 320, it comes to rest against a float collar or other plug landing surface commonly used in this art at or near the bottom of the casing string. As a special feature of the present invention, means are provided for bending over and holding the ball 70 from falling out of its seating arrangement within the sleeve 300. By further increasing pump pressure at the earth's surface, the differential fluid pressure across the first dropped ball increases to a predetermined value, i.e., to 1,250 psi, shearing a second set of shear pins 410, and forcing the collet end of the sleeve to be forced through the axial bore 368, resulting in the sleeve 300 coming to rest against the end cap 402. When the sleeve 300 bottoms out, this causes the plurality of holes 400 to be uncovered, allowing fluid to be pumped out of the holes 400, either to fill up the casing, to circulate fluid, to cause cement to exit out of the casing, or to otherwise control fluid in a casing string.

When the operator desires to separate the top mandrel, the second, largest ball is dropped. The second dropped ball reaches the narrowed-down opening 327 to axial bore 328, and seals off that opening. By increasing pump pressure to a predetermined amount, i.e., 1,500 psi, the collet end 324 of the upper mandrel is pulled out of a fill-up and circulation tool or whatever other tool or apparatus is located immediately above the upper mandrel, shearing any shear pins as necessary and thus, the top cement plug can be pumped down the interior of the casing string. As a final step, the top mandrel is pumped down until it settles over the lower mandrel and the job is completed, usually by drilling out the lower and upper mandrels with their respective cement plugs.

In an alternative embodiment of using the apparatus according to the present invention, when it is desired to circulate fluids or fill up the casing with fluids, and it is not necessary, nor desired, to have the cement plugs be separated from the apparatus as contemplated by FIG. 1, the entire assembly comprised of the first and second cement plugs can be separated as a unit merely by dropping the second, large ball without having dropped the first, smaller ball, or upper mandrel 320 and the lower mandrel 360 can be bolted securely together, resulting in the ability to move the sleeve 300 down to uncover the holes 400 without separating the lower mandrel 360 from the upper mandrel 320.

What is claimed is:

1. A method for cementing a casing string into an earth borehole, said casing string having an upper portion and a lower portion, said method comprising:

securing an upper mandrel to a lower mandrel utilizing a sleeve detachably mounted to said upper mandrel while being maintained within said lower mandrel, said sleeve having a sealable seat at its upper end;

positioning said upper mandrel and said lower mandrel within said earth borehole;

dropping a first ball of a given diameter into said earth borehole, and allowing said first ball to come to rest against said sealable seat of said sleeve;

increasing at the earth's surface, to a first pressure level, the pump pressure pumped against said first ball to shear at least one first shear pin detachably mounting said sleeve within said upper mandrel until said first pressure is applied, thereby causing said lower mandrel maintaining said sleeve to separate from said upper mandrel;

pumping said lower mandrel downwardly through a plurality of tubulars comprising said casing string as a selected volume of cement is pumped into said earth borehole;

increasing at the earth's surface, to a second pressure higher than said first pressure level, the pump pressure against said first ball to shear at least one second shear pin within said lower mandrel to move said sleeve downwardly within said lower mandrel, thereby allowing said cement to be pumped through said lower mandrel and through said lower portion of said casing string and into an annulus between said casing string and said earth borehole to thereby cement said casing string within said earth borehole.

2. The method according to claim 1, further comprising providing an elastomeric seal around said lower mandrel for sealing engagement between said lower mandrel and said casing string.

3. A method for cementing a casing string into an earth borehole, said casing string having an upper portion and a lower portion, said method comprising:

securing an upper mandrel to a lower mandrel; mounting said upper mandrel and said lower mandrel within said earth borehole;

dropping a first ball of a given diameter into said earth borehole, and allowing said first ball to come to rest within the upper end of a sleeve positioned between a lower end of said upper mandrel and an upper end of said lower mandrel, and said sleeve having an internal diameter less than said given diameter;

increasing at the earth's surface, to a first pressure level, the pump pressure against said first ball to shear a first set of shear pins maintaining said sleeve within said upper mandrel, thereby causing said lower mandrel to separate from said upper mandrel and move downwardly as a selected volume of cement is pumped into said earth borehole to thereby push said upper mandrel to a resting position at said lower portion of said casing string;

increasing at the earth's surface, to a second pressure higher than said first pressure level, the pump pressure against said first ball to shear a second set of shear pins within said lower mandrel to move said sleeve downwardly within said lower mandrel, thereby allowing cement to be pumped through said lower mandrel and through said lower portion of said casing string and into an annulus between said casing string and said earth borehole to thereby cement said casing string within said earth borehole;

dropping a second ball of a diameter greater than the given diameter of said first ball, into the upper end of said tubular string, and allowing said second ball to come to rest within an opening in said upper mandrel having an internal diameter less than the diameter of said second ball; and applying at the earth's surface and against said second ball a pressure sufficient to cause said upper mandrel to move downwardly within said casing string and engage said lower mandrel at said lower portion of said casing string.

4. The method according to claim 3, further comprising providing an elastomeric seal around said lower mandrel for sealing engagement between said lower mandrel and said casing string, and providing an elastomeric seal around said upper mandrel for sealing engagement between said upper mandrel and said casing string.

5. A method for cementing a casing string into an earth borehole, said casing string having an upper portion and a lower portion, said method comprising:

securing an upper mandrel to a lower mandrel utilizing a sleeve detachably mounted to said upper mandrel while being maintained within said lower mandrel, said sleeve having a sealable seat at its upper end;

positioning said upper mandrel and said lower mandrel within said earth borehole;

dropping a first ball of a given diameter into said earth borehole;

increasing at the earth's surface, to a first pressure level, the pump pressure of a fluid pumped into said earth borehole and against said first ball to shear a first shear pin detachably mounting said sleeve within said upper mandrel until said first pressure is applied, thereby moving said sleeve and causing said lower mandrel maintaining said sleeve to separate from said upper mandrel;

pumping of a fluid after separation of said lower mandrel from said upper mandrel to move said lower mandrel downwardly through a plurality of casing tubulars forming said casing string as a selected volume of cement is pumped into said earth;

increasing at the earth's surface, to a second pressure higher than said first pressure level, the pump pressure of the fluid pumped into said earth borehole and against said first ball thereby moving said sleeve to open a passageway through said lower mandrel allowing fluid to be pumped through said lower mandrel and through said lower portion of said casing string and into an annulus between said casing string and said earth borehole to thereby cement said casing string within said earth borehole.

6. The method according to claim 5, further comprising providing an elastomeric seal around said lower mandrel for sealing engagement between said lower mandrel and said casing string.

7. A method for cementing a casing string into an earth borehole, said casing string having an upper portion and a lower portion, said method comprising:

securing an upper mandrel to a lower mandrel utilizing a sleeve;

mounting said upper mandrel and said lower mandrel within said earth borehole;

dropping a first ball of a given diameter into said earth borehole, and allowing said first ball to come to rest within the upper end of said sleeve positioned between a lower end of said upper mandrel and an upper end of said lower mandrel, said sleeve having an internal diameter less than said given diameter;

increasing at the earth's surface, to a first pressure level, the pump pressure of a fluid pumped into said earth borehole and against said first ball to shear a first shear pin maintaining said sleeve within said upper mandrel, thereby causing said lower mandrel to separate from said upper mandrel and move downwardly as a selected volume of cement is pumped into said earth borehole to thereby push said upper mandrel to a resting position at said lower portion of said casing string;

increasing at the earth's surface, to a second pressure higher than said first pressure level, the pump pressure of the fluid pumped into said earth borehole and against said first ball to shear a second shear pin within said lower mandrel to move said sleeve downwardly within said lower mandrel, thereby allowing fluid to be pumped through said lower mandrel and through said lower portion of said casing string and into an annulus between said casing string and said earth borehole to thereby cement said casing string within said earth borehole;

dropping a second ball of a diameter greater than the given diameter of said first ball, into the upper end of said earth borehole, and allowing said second ball to come to rest within an opening in said upper mandrel having an internal diameter less than the diameter of said second ball; and applying at the earth's surface and against said second ball a pressure sufficient to cause said upper mandrel to move downwardly within said casing string and engage said lower mandrel at said lower portion of said casing string.

8. The method according to claim 7, further comprising providing an elastomeric seal around said lower mandrel for sealing engagement between said lower mandrel and said casing string, and providing an elastomeric seal around said upper mandrel for sealing engagement between said upper mandrel and said casing string.

9. An apparatus for controlling the flow of fluid out the lower end of a casing string suspended in an earth borehole for supplying cement into an annulus between said casing string and said earth borehole, comprising:

a first lower mandrel positionable within the interior of said earth borehole and having a first internal fluid passageway along its length;

a second, upper mandrel, positionable within the interior of said earth borehole and having a second internal fluid passageway along its length, and having a given internal diameter, said first and second fluid passageways being in fluid communication with each other;

a plurality of bearings positioned between said lower mandrel and said upper mandrel;

a sleeve in cooperation with said plurality of bearings being configured and positioned for detachably connecting and permitting relative rotation between said lower mandrel and said upper mandrel, said sleeve being detachably mounted to said upper mandrel through the use of a first set of shear pins and wherein said sleeve is also being maintained within said lower mandrel through the use of a second set of shear pins, said sleeve having an internal diameter less than said given diameter, said first set of shear pins being shearable by a given force, wherein dropping a first ball having a diameter less than the given internal diameter of the upper mandrel and thereafter increasing the pump pressure of the fluid at the earth's surface, and thereby supplying such pressurized fluid through the tubular string to said upper and lower mandrels, shears said first set of shear pins and causes the lower mandrel to separate from the upper mandrel; and an elastomeric seal positioned around an outer surface of said first lower mandrel sized to seal between said first lower mandrel and said casing to prevent fluid flow between said outer surface of said lower mandrel and said casing.

10. The apparatus according to claim 9, being further characterized by a collet connection located at the top end of said upper mandrel for forming a connection between said tubular strings and said upper mandrel.

11. The apparatus of claim 9, being further characterized by a float collar or plug landing surface located at the lower end of said mandrel.

12. An apparatus for controlling, through the use of two dropped balls and an increase of the pump pressure at the earth's surface, the flow of fluid out of the lower end of a casing string suspended in an earth borehole to permit fluid flow into an annulus between said casing string and said earth borehole for cementing said casing within said earth borehole, comprising:

a first, lower mandrel;

an elastomeric seal positioned around an outer surface of said first lower mandrel sized to seal between said first lower mandrel and said casing to prevent fluid flow between said outer surface of said lower mandrel and said casing;

a sleeve shearably connected within the interior of said lower mandrel by a first set of shear pins and having a first receptacle with a first given diameter for receiving and holding a first dropped ball having a diameter greater than said first given diameter;

a second upper mandrel detachably connected to said lower mandrel through said sleeve, said upper mandrel having a second receptacle with a second given diameter for receiving and holding a second dropped ball having a diameter greater than the diameter of said second given diameter, the diameter of said first dropped ball being smaller than the diameter of said second dropped ball; and means for relative rotation and detachable connection between said lower mandrel and said upper mandrel.

13. An apparatus for controlling, through the use of two dropped balls and an increase of the pump pressure at the earth's surface, the flow of fluid out of the lower end of a casing string suspended in an earth borehole operable to permit cement flow into an annulus between said casing string and said earth borehole for cementing said casing within said earth borehole, comprising:

a first, lower mandrel;

an elastomeric seal positioned around an outer surface of said first lower mandrel sized to seal between said first lower mandrel and said casing to prevent fluid flow between said outer surface of said lower mandrel and said casing;

a sleeve shearably connected within the interior of said lower mandrel by a first shear member and supporting a first receptacle with a first given diameter for receiving and holding a first dropped ball having a diameter greater than said first given diameter;

a second upper mandrel detachably connected to said lower mandrel through said sleeve, said upper mandrel supporting a second receptacle with a second given diameter for receiving and holding a second dropped ball having a diameter greater than the diameter of said second given diameter, the diameter of said first dropped ball being smaller than the diameter of said second dropped ball; and means for relative rotation and detachable connection between said lower mandrel and said upper mandrel.

14. An apparatus for controlling the flow of fluid out the lower end of a casing string suspended in an earth borehole for supplying cement into an annulus between said casing string and said earth borehole, comprising:

a first lower mandrel positionable within the interior of said earth borehole and having a first internal fluid passageway along its length;

a second, upper mandrel, positionable within the interior of said earth borehole and having a second internal fluid passageway along its length, and having a given internal diameter, said first and second fluid passageways being in fluid communication with each other;

a plurality of bearings positioned between said lower mandrel and said upper mandrel;

a sleeve in cooperation with said plurality of bearings being configured and positioned for detachably connecting and permitting relative rotation between said lower mandrel and said upper mandrel, said sleeve being detachably mounted to said upper mandrel through the use of a first set of shear pins and wherein said sleeve is also being maintained within said lower mandrel through the use of a second set of shear pins, said sleeve having an internal diameter less than said given diameter, said first set of shear pins being shearable by a given force, wherein dropping a first ball having a diameter less than the given internal diameter of the upper mandrel and thereafter increasing the pump pressure of the fluid at the earth's surface, and thereby supplying such pressurized fluid through the casing string to said upper and lower mandrels, shears said first set of shear pins and causes the lower mandrel to separate from the upper mandrel; and an elastomeric seal positioned around an outer surface of said first lower mandrel sized to seal between said first lower mandrel and said casing to prevent fluid flow between said outer surface of said lower mandrel and said casing.

15. The apparatus according to claim 14, wherein said plurality of bearings comprises a plurality of balls.

16. The apparatus according to claim 14, wherein said lower mandrel, said upper mandrel, and said sleeve are configured and positioned to form an annular bearing-race-like cavity, said plurality of bearings residing in said cavity so as to permit relative rotation of said lower mandrel and said upper mandrel.

17. The apparatus according to claim 16, wherein said plurality of bearings are releaseably secured within said annular bearing-race-like cavity by the outer surface of said sleeve.

18. The apparatus according to claim 17, wherein said sleeve has a central axis, and wherein downward axial movement of said sleeve opens said bearing-race-like cavity permitting said plurality of bearings to fall out of said cavity, thereby detachably disconnecting said lower mandrel from said upper mandrel.

19. An apparatus for controlling the flow of fluid out the lower end of a casing string suspended in an earth borehole for supplying cement into an annulus between said casing string and said earth borehole, comprising:

a first lower mandrel positionable within the interior of said earth borehole and having a first internal fluid passageway along its length;

a second, upper mandrel, positionable within the interior of said earth borehole and having a second internal fluid passageway along its length, and having a given internal diameter, said first and second fluid passageways being in fluid communication with each other;

a plurality of balls positioned between said lower mandrel and said upper mandrel;

a sleeve in cooperation with said plurality of balls being configured and positioned for detachably connecting said lower mandrel to said upper mandrel; and an elastomeric seal positioned around an outer surface of said first lower mandrel sized to seal between said first lower mandrel and said casing to prevent fluid flow between said outer surface of said lower mandrel and said casing.

20. The apparatus according to claim 19, wherein said sleeve cooperates with said plurality of balls being configured and positioned for permitting relative rotation between said lower mandrel and said upper mandrel.

21. An apparatus for controlling the flow of fluid out the lower end of a casing string suspended in an earth borehole for supplying cement into an annulus between said casing string and said earth borehole, comprising:

a first lower mandrel positionable within the interior of said earth borehole and having a first internal fluid passageway along its length;

a second, upper mandrel, positionable within the interior of said earth borehole and having a second internal fluid passageway along its length, and having a given internal diameter, said first and second fluid passageways being in fluid communication with each other;

a plurality of balls positioned between said lower mandrel and said upper mandrel;

a sleeve in cooperation with said plurality of balls being configured and positioned for permitting relative rotation between said lower mandrel and said upper mandrel; and an elastomeric seal positioned around an outer surface of said first lower mandrel sized to seal between said first lower mandrel and said casing to prevent fluid flow between said outer surface of said lower mandrel and said casing.

22. The apparatus according to claim 21, wherein said sleeve cooperates with said plurality of balls for detachably connecting said lower mandrel to said upper mandrel.

* * * * *